US011264685B2

(12) United States Patent
Ding

(10) Patent No.: US 11,264,685 B2
(45) Date of Patent: Mar. 1, 2022

(54) LINKAGE MECHANISM FOR PHASE SHIFTER ASSEMBLY

(71) Applicant: CommScope Technologies LLC, Hickory, NC (US)

(72) Inventor: Guomin Ding, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/050,580

(22) PCT Filed: May 9, 2019

(86) PCT No.: PCT/US2019/031409
§ 371 (c)(1),
(2) Date: Oct. 26, 2020

(87) PCT Pub. No.: WO2019/222008
PCT Pub. Date: Nov. 21, 2019

(65) Prior Publication Data

US 2021/0242551 A1 Aug. 5, 2021

(30) Foreign Application Priority Data

May 16, 2018 (CN) ..... 201810464562.X

(51) Int. Cl.
*H01P 1/18* (2006.01)
*H01P 5/04* (2006.01)

(52) U.S. Cl.
CPC ..... *H01P 1/182* (2013.01); *H01P 1/184* (2013.01); *H01P 5/04* (2013.01)

(58) Field of Classification Search
CPC .. H01P 1/182; H01P 5/04; H01P 1/184; H01P 1/18; H01Q 3/32
(Continued)

(56) References Cited

U.S. PATENT DOCUMENTS 6,603,436 B2 8/2003 Heinz et al.
2002/0113750 A1 8/2002 Heinz et al.
(Continued)

FOREIGN PATENT DOCUMENTS

CN 1167545 A 12/1997
CN 107403981 A 11/2017

OTHER PUBLICATIONS

"International Preliminary Report on Patentability corresponding to International Application No. PCT/US2019/031409 dated Nov. 26, 2020".

(Continued)

*Primary Examiner* — Robert J Pascal
*Assistant Examiner* — Jorge L Salazar, Jr.
(74) *Attorney, Agent, or Firm* — Myers Bigel, P.A.

(57) ABSTRACT

The present disclosure relates to a linkage mechanism for a phase shifter assembly, comprising a rotation device having a rotation shaft fixed to a substrate of the phase shifter assembly and a rotation member configured to rotate about said rotation shaft; a first drive member which can be operatively engaged to the rotation member such that rotation of the rotation member can cause movement of the first drive member; a second drive member disposed on and moving together with the rotation member; and a translation device including a translation member which can be operatively engaged to the second drive member such that movement of the second drive member can cause movement of the translation member, wherein the rotation device and the translation device are configured to move in association with each other during operation of the phase shifter assembly. The present disclosure also relates to a phase shifter assembly including the above-mentioned linkage mechanism.

19 Claims, 3 Drawing Sheets

(58) Field of Classification Search
USPC ..... 333/24 R, 139, 156, 161
See application file for complete search history.

(56) References Cited

U.S. PATENT DOCUMENTS

| | | | | |
|---|---|---|---|---|
| 2008/0024385 | A1* | 1/2008 | Zimmerman | H01Q 3/32 343/905 |
| 2008/0070507 | A1 | 3/2008 | Stoyanov | |
| 2016/0134007 | A1 | 5/2016 | Ding et al. | |
| 2017/0365923 | A1 | 12/2017 | Schmutzler et al. | |

OTHER PUBLICATIONS

"International Search Report corresponding to International Application No. PCT/US2019/031409 dated Aug. 23, 2019".
"Office Action corresponding to Chinese Application No. 201810464562.X dated Jul. 29, 2021".

* cited by examiner

LINKAGE MECHANISM FOR PHASE SHIFTER ASSEMBLY

RELATED APPLICATIONS

The present application is a 35 U.S.C. § 371 national phase application of and claims priority to PCT Application PCT/US2019/031409 filed May 9, 2019, which claims priority from and the benefit of Chinese Patent Application No. 201810464562.X, filed May 16, 2018, the disclosure of each of which is hereby incorporated herein by reference in its entirety.

FIELD OF THE INVENTION

The present disclosure generally relates to the field of phase shifters. More specifically, the present disclosure relates to a linkage mechanism for a phase shifter assembly. Moreover, the present disclosure also relates to a phase shifter assembly including the linkage mechanism.

DESCRIPTION OF RELATED ART

A variable difference phase shifter introduces a desired phase shift in RF (radio frequency) energy distributions between two or more outputs. For example, a variable differential phase shifter may be used as a component in an electrically variable beam tilting and/or azimuth scanning angle antenna system of a cellular communication base station. The desired phase shift is typically obtained by modifying the electrical path required to reach each output of the phase shifter relative to other outputs. In a common design method, in order to adjust the electrical path, the transmission line through the phase shifter includes a conductive arc. The phase shifter further includes a slider that pivots at the center of the arc to move along the surface of the arc. An RF signal is input and distributed from the slider to outputs at either end of the conductive arc. The length of the electrical path to each output—and hence the phase shift—depends on the position of the slider along the conductive arc.

SUMMARY OF THE INVENTION

An object of the present disclosure is to provide a phase shifter assembly and a linkage mechanism for the phase shifter assembly.

According to an aspect of the present disclosure, a linkage mechanism for a phase shifter assembly is provided, comprising:

a rotation device including:

a rotation shaft secured to a substrate of the phase shifter assembly; and a rotation member configured to rotate about the rotating shaft;

a first drive member that is operatively engaged to the rotation member such that rotation of the rotation member can cause movement of the first drive member;

a second drive member disposed on and moving together with the rotation member; and a translation device including:

a translation member that is operatively engaged to the second drive member such that movement of the second drive member can cause movement of the translation member, wherein the rotation device and the translation device are configured to move in association with each other during operation of the phase shifter assembly.

In an embodiment of the linkage mechanism, movement of the translation device with respect to the first drive member may be adjusted by location of the first drive member and/or the second drive member with respect to the rotation shaft.

In an embodiment of the linkage mechanism, the rotation member is provided with a guide, and the first drive member can move along the guide of the rotation member.

In an embodiment of the linkage mechanism, the translation member is provided with a guide, and the second drive member can move along the guide of the translation member.

In an embodiment of the linkage mechanism, the first drive member can be operatively engaged to the rotation member at different positions of the rotation member so as to change the proportional relationship between movement of the rotation member and movement of the first drive member.

In an embodiment of the linkage mechanism, the second drive member can be fixed to the rotation member at different positions of the rotation member so as to change the proportional relationship between movement of the rotation member and movement of the translation member.

In an embodiment of the linkage mechanism, the linkage mechanism is further provided with a third drive member disposed on the rotation member and coupled to an external drive source, wherein the third drive member is configured to drive the rotation member to rotate about the rotation shaft.

In an embodiment of the linkage mechanism, location of the third drive member relative to the rotation shaft is adjustable.

In an embodiment of the linkage mechanism, the translation device further includes a connection member, and the translation member is fixed to the connection member.

In an embodiment of the linkage mechanism, the connection member includes connection rods arranged parallel to each other and a cross member arranged substantially perpendicular to the connection rods and connecting the connection rods to each other.

According to another aspect of the present disclosure, a phase shifter assembly is provided, comprising:

the linkage mechanism as described above;

a first-stage phase shifter, the first drive member being coupled to the first-stage phase shifter to drive the first-stage phase shifter to operate; and a second-stage phase shifter, the translation member being coupled to the second-stage phase shifter to drive the second-stage phase shifter to operate.

In an embodiment of the phase shifter assembly, the first-stage phase shifter and the second-stage phase shifter are disposed on the same printed circuit board and operate in association with each other by means of the linkage mechanism. The arrangement of the first-stage phase shifter and the second-stage phase shifter on the same printed circuit board reduces the required area of the printed circuit board and the costs of the phase shifter assembly.

In an embodiment of the phase shifter assembly, an output ratio between the first-stage phase shifter and the second-stage phase shifter can be adjusted by location of the first drive member and/or the second drive member with respect to the rotation shaft.

In an embodiment of the phase shifter assembly, the first-stage phase shifter is a rotary phase shifter and the second-stage phase shifter is a sliding phase shifter.

In an embodiment of the phase shifter assembly, the phase shifter assembly includes one first-stage phase shifter and a plurality of second-stage phase shifters.

In an embodiment of the phase shifter assembly, the phase shifter assembly includes one first-stage phase shifter and five second-stage phase shifters.

By the phase shifter assembly according to the present disclosure, different types of the phase shifters can be disposed in the same assembly while allowing them to operate in a proportional relationship; further, such proportional relationship can be adjusted to thereby acquire a desired output.

In an embodiment of the phase shifter assembly, the translation device further includes a connection member, and the translation member is fixed to the connection member.

In an embodiment of the phase shifter assembly, the connection member includes connection rods arranged parallel to each other and a cross member arranged substantially perpendicular to the connection rods and connecting the connection rods to each other.

In an embodiment of the phase shifter assembly, the phase shifter assembly further includes a fourth drive member fixed to the second-stage phase shifter, wherein the cross member is operatively coupled to the fourth drive member so that the translation member drives the second-stage phase shifter to operate via the connection member, the cross member and the fourth drive member.

In an embodiment of the phase shifter assembly, the cross member is provided with a guide, and the fourth drive member can move along the guide of the cross member.

According to a further aspect of the present disclosure, a phase shifter assembly is provided, comprising:

a printed circuit board;

a first electromechanical phase shifter that is partially implemented on the printed circuit board, the first electromechanical phase shifter including a first moveable member;

a second electromechanical phase shifter that is partially implemented on the printed circuit board, the second electromechanical phase shifter including a second moveable member;

a mechanical linkage mechanism that moves the second moveable member in response to movement of the first moveable member.

In an embodiment of the phase shifter assembly, the first electromechanical phase shifter is a rotary phase shifter and the second electromechanical phase shifter is a linearly sliding phase shifter.

In a case where the above-described translation device is adopted, the translation device may connect a plurality of the second-stage phase shifters for simultaneous operation, and thus multiple output signals can be generated by use of the multiple second-stage phase shifters to meet various application requirements.

BRIEF DESCRIPTION OF THE DRAWINGS

After reading the embodiments below in combination with the drawings, a plurality of aspects of the present disclosure will be better understood. In the drawings.

DETAILED DESCRIPTION

Figure 1:
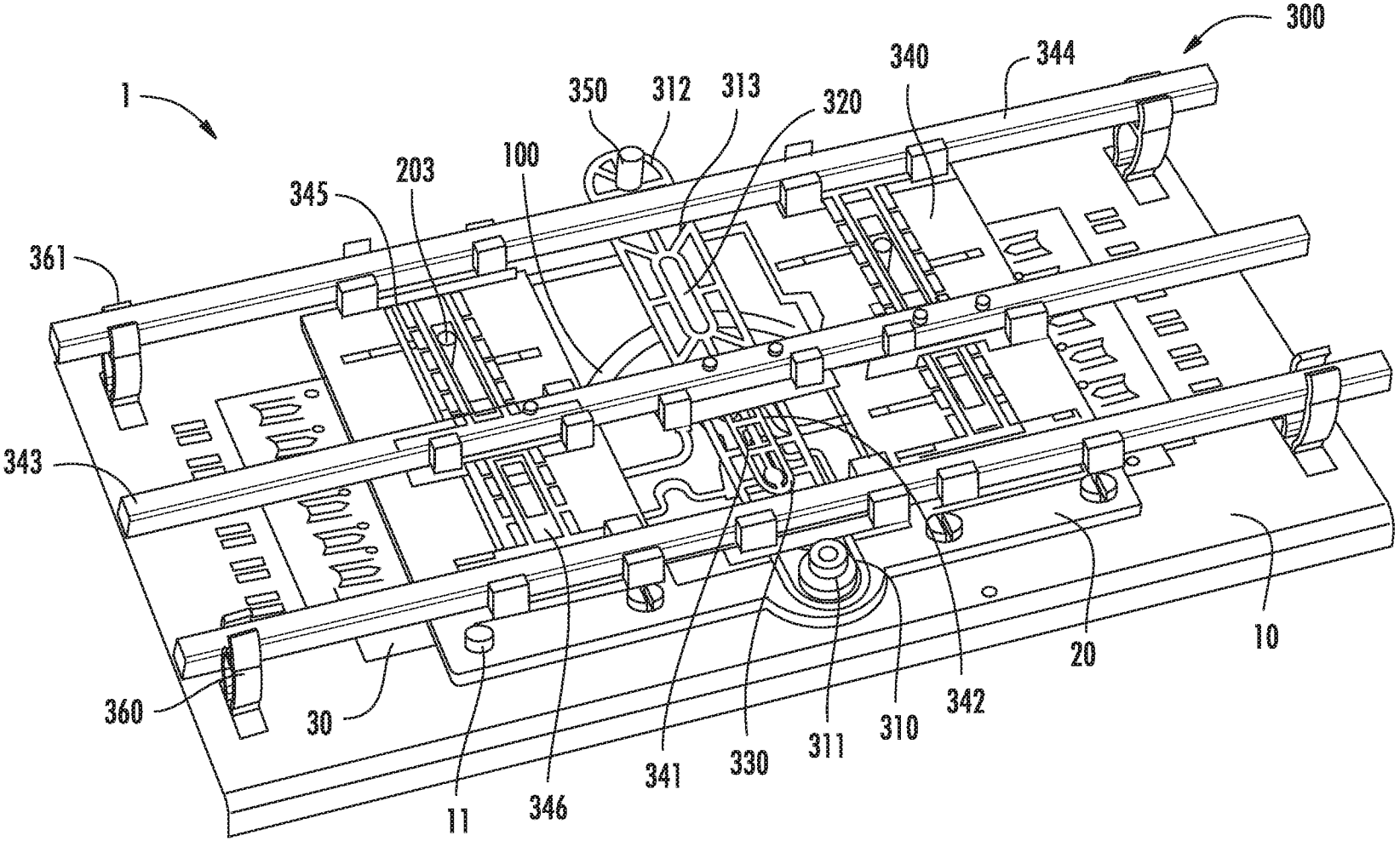
FIG. 1 is a perspective view of a phase shifter assembly according to the present disclosure.

The present disclosure will be described as follows with reference to the accompanying drawings, in which certain embodiments of the present disclosure are shown. However, it is to be understood that the present disclosure may be embodied in many different forms and should not be construed as limited to the embodiments that are pictured and described herein. Rather, these embodiments are provided so that this disclosure will be thorough and complete, and will fully convey the scope of the invention to those skilled in the art. It will also be appreciated that the embodiments disclosed herein can be combined in any way to provide many additional embodiments.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Embodiments of the phase shifter assembly according to the present disclosure will be described in detail below with reference to the accompanying drawings. For ease of description, the direction along a length of the phase shifter assembly is defined as a longitudinal direction, the direction along a width of the phase shifter assembly is defined as a transverse direction, and the direction along a thickness of the phase shifter assembly is defined as a vertical direction. For example, for the graphical representation in the drawings, in FIGS. 3 and 4, the left-right direction is the longitudinal direction, the up-down direction is the transverse direction, and the direction perpendicular to the page is the vertical direction.

Refer to FIG. 1, which shows a perspective view of a phase shifter assembly 1 according to an embodiment of the present disclosure. The phase shifter assembly 1 includes a substrate 10 and an overlay 20 that are disposed oppositely and spaced apart from one another and are secured together by a fastener 11. A PCB 30 is disposed between the substrate 10 and the overlay 20, and is fixed to the substrate 10.

The phase shifter assembly 1 further includes at least a first-stage phase shifter 100 and a second-stage phase shifter 200 (see FIG. 2) disposed between the substrate 10 and the overlay 20. Hereinafter, the first-stage phase shifter is shown as a rotary phase shifter, and the second-stage phase shifter is shown as a sliding phase shifter; however, this is merely exemplary and is not limiting, and those skilled in the art can appreciate that the first-stage phase shifter and the second-stage phase shifter may be any suitable phase shifter known in the art. Further, the number of the first-stage phase shifters and the number of second-stage phase shifters is not limited to the number shown in the following embodiment.

Figure 2:
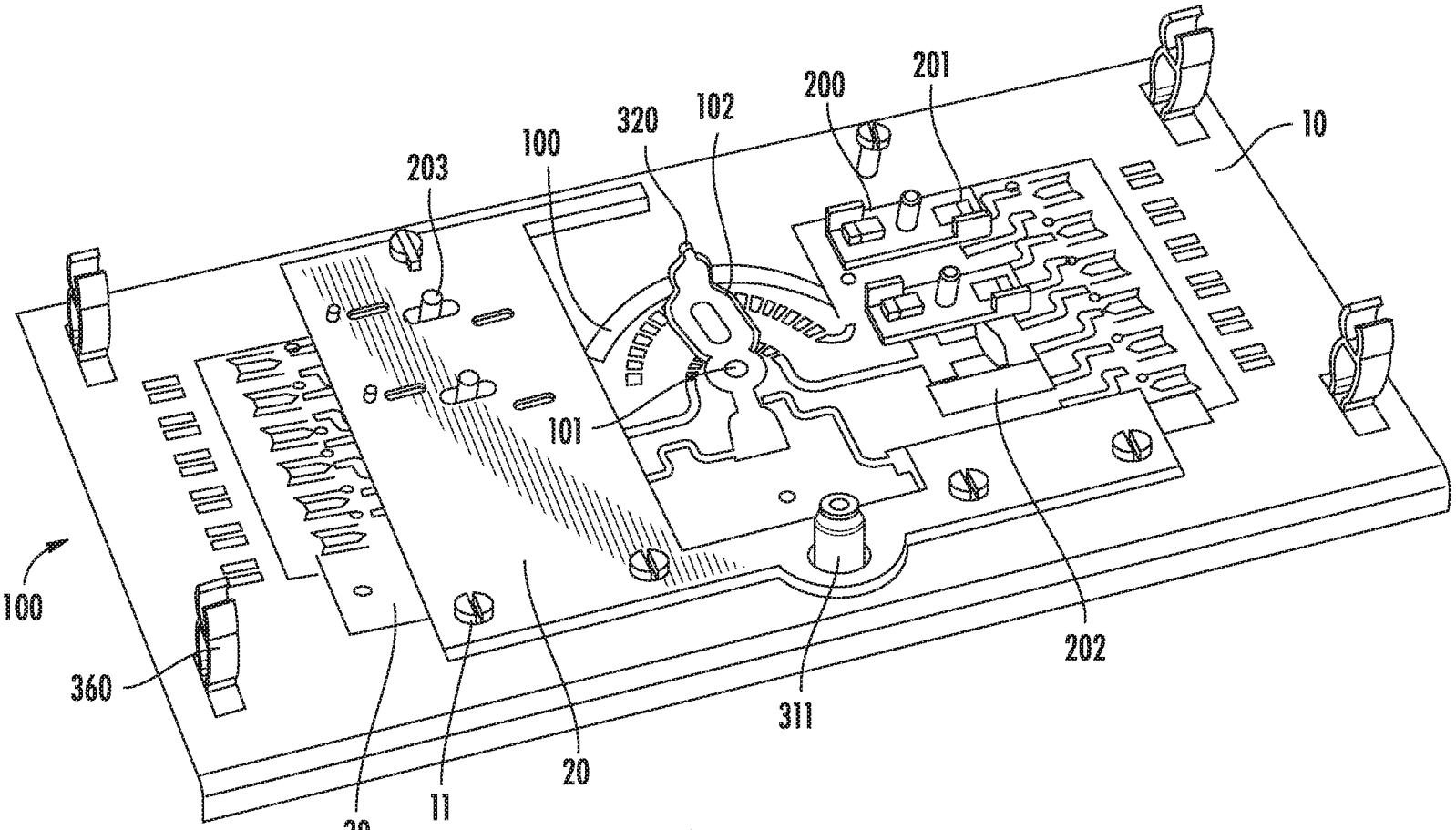
FIG. 2 is a partial perspective view of the phase shifter assembly in FIG. 1 with the linkage mechanism removed.

Refer to FIG. 2, which is a partial perspective view of the phase shifter assembly in FIG. 1. The first-stage phase shifter 100 is a rotary phase shifter including a shaft 101 such as a pivot pin and a slider support 102 that is rotatable about the shaft 101. A slider (not shown) is fixed to an underside of the slider support 102 and contacts the PCB 30. As the slider support 102 rotates about the shaft 101, the slider slides relative to the PCB 30. The relative movement between the slider and the PCB 30 can result in a phase change, whereby a first-stage output signal indicative of the phase change can be generated. In the embodiment shown in the drawing, one first-stage phase shifter 100 is shown, but those skilled in the art can appreciate that more than one first-stage phase shifter may be employed.

The second-stage phase shifter 200 is a sliding phase shifter including a slider support 201. A slider 202 is fixed to the slider support 201 and is in contact with the PCB 30. The slider support 201 can be translated in the longitudinal direction, causing the slider 202 to slide relative to the PCB 30. The relative movement between the slider 202 and the PCB 30 can result in a phase change, whereby a second-stage output signal indicative of the phase change can be generated. In the embodiment shown in the drawing, five second-stage phase shifters 200 are shown, but those skilled in the art can appreciate that more or fewer second-stage phase shifters may be employed.

The first-stage phase shifter 100 and the second-stage phase shifter 200 may operate in coordination with each other. For example, movement of the slider support 102 of the first-stage phase shifter 100 and movement of the slider support 201 of the second-stage phase shifter 200 may be associated with each other. Specifically, this can be implemented by a linkage mechanism 300.

The linkage mechanism 300 has a rotation device 310 including a rotation shaft 311 such as a pivot pin that is fixed to the substrate 10, and a rotation member 312 that is pivotally coupled to the rotation shaft 311. In the embodiment as shown in the drawing, the rotation member 312 can rotate about the rotation shaft 311 in a plane substantially parallel to the substrate 10 and the PCB 30.

The linkage mechanism 300 further includes a first drive member 320 disposed on the slider support 102 of the first-stage phase shifter 100, e.g., being fixed to the slider support 102 or integrated with the slider support 102.

The first drive member 320 can be operatively coupled to the rotation member 312 such that rotation of the rotation member 312 about the rotation shaft 311 can cause movement of the first drive member 320. Movement of the first drive member 320 in turn causes movement of the slider support 102 of the first-stage phase shifter 100. In the case where the first-stage phase shifter 100 is the rotary phase shifter, movement of the first drive member 320 causes the slider support 102 to rotate about the shaft 101 so that the slider of the first-stage phase shifter 100 slides relative to the PCB 30 to generate a first-stage output signal indicative of the phase change.

In an embodiment, the rotation member 312 may be provided with a guide 313 for guiding movement of the first drive member 320 during rotation of the rotation member 312 about the rotation shaft 311. For example, the first drive member 320 can move along the guide 313 to move together with the rotation member 312 during rotation of the rotation member 312 about the rotation shaft 311.

In the embodiment shown in FIG. 1, the guide 313 may be in the form of a guide slot, and in this case the first drive member 320 may be in the form of a guide pin. The guide pin extends into the guide slot and can slide within the guide slot. When the rotation member 312 rotates about the rotation shaft 311, the first drive member 320 in the form of the guide pin rotates with the rotation member 312 due to the constraint of the guide slot, and meanwhile the guide pin can slide along the guide slot so as to adapt to rotation of the slider support 102 about the shaft 101.

The linkage mechanism 300 includes a second drive member 330 disposed on the rotation member 312 so that the second drive member 330 can move with the rotation member 312, that is, the second drive member 330 can rotate about the rotation shaft 311 together with the rotation member 312.

The linkage mechanism 300 further includes a translation device 340 including a translation member 341 that can be operatively engaged to the second drive member 330 such that movement of the second drive member 330 can cause movement of the translation member 341. The translation member 341 may be directly or indirectly coupled to the slider support 201 of the second-stage phase shifter 200, whereby movement of the translation member 341 causes movement of the slider support 201 of the second-stage phase shifter 200. In the case where the second-stage phase shifter 200 is the sliding phase shifter, movement of the translation member 341 causes the slider support 201 to move, for example, in the longitudinal direction of the phase shifter assembly 1, so that the slider 202 of the second-stage phase shifter 200 slides relative to the PCB 30 to thereby generate a second-stage output signal indicative of the phase change.

In the case where the second-stage phase shifter 200 is the sliding phase shifter, the slider support 201 is required to be movable, for example, in the longitudinal direction of the phase shifter assembly 1. In this instance, the translation member 341 may be provided with a guide 342 for guiding movement of the second drive member 330 during rotation of the rotation member 312 about the rotation shaft 311. For example, the second drive member 330 can move along the guide 342 during rotation of the rotation member 312 about the rotation shaft 311. Thus, as the second drive member 330 moves along the guide 342 in response to the rotation member 312 rotating about the rotation shaft 311, the translation member 341 moves in the longitudinal direction of the phase shifter assembly 1.

In the embodiment shown in FIG. 1, the guide 342 may be a guide slot, and in this case the second drive member 330 may be a guide pin. The guide pin extends into the guide slot and can slide within the guide slot. When the rotation member 312 rotates about the rotation shaft 311, the second drive member 330 rotates with the rotation member 312. At the same time, owing to constraint of the guide slot, the guide pin can slide along the guide slot, whereby the translation member 341 can be moved in the longitudinal direction of the phase shifter assembly 1.

The linkage mechanism 300 may include a third drive member 350 disposed on the rotation member 312 and operatively coupled to an external drive source (not shown) which drives the third drive member 350 to thereby cause the rotation member 312 to rotate about the rotation shaft 311.

The third drive member 350 may be coupled with the external drive source by various means. For example, the external drive source may be provided with a drive shaft which is connected with the third drive member 350 to drive the third drive member 350. The third drive member 350 may be in the form of a guide pin, and correspondingly, the drive shaft is provided with a guide which may be in the form of a guide slot, and the guide pin is disposed in the guide slot and can move along the guide slot. In this way, the drive shaft may be arranged to perform translational movement, for example, in the longitudinal direction. With the above-described arrangement, the translational movement of the drive shaft can still drive the third drive member 350 to carry out rotational movement about the rotation shaft 311, which in turn causes the rotation member 312 to rotate about the rotation shaft 311.

As a non-limiting example, a plurality of the second-stage phase shifters 200 are shown in the embodiment shown in the figure. For this purpose, the translation device 340 may be configured to allow the plurality of the second-stage phase shifters 200 to move simultaneously.

Specifically, the translation device 340 may further include a connection member 343 that may be fixed to the translation member 341 and coupled to the slider support 201 of the second-stage phase shifter 200 so that the connection member 343 can move with the translation member 341, and whereby the slider support 201 of the second-stage phase shifter 200 can perform a translational movement relative to the slider 202 in the longitudinal direction of the phase shifter assembly 1.

Further, in an embodiment, the connection member 343 may include a plurality of connection rods 344 arranged parallel to each other and a cross member 345 arranged substantially perpendicular to the connection rods 344 and connecting the connection rods 344 to each other. The connection rods 344 may extend substantially in the longitudinal direction, and correspondingly the cross member 345 extends substantially in the transverse direction. The cross member 345 is operatively coupled to the slider support 201 of the second-stage phase shifter 200, whereby the cross member 345 causes movement of the slider support 201 of the second-stage phase shifter 200 relative to the slider 202. As a non-limiting example, the slider support 201 may be provided with a fourth drive member which may be in the form of a guide pin 203, and the cross member 345 is coupled to the guide pin 203 to drive the guide pin 203 to perform translational movement in the longitudinal direction of the phase shifter assembly 1.

In order to accommodate the manufacturing tolerances of the phase shifter and avoid interference, the cross member 345 may be provided with a guide 346 which may be in the form of a guide slot. In this case, the guide pin 203 extends into the guide slot and can slide within the guide slot, to ensure translational movement of the guide pin 203 in the longitudinal direction of the phase shifter assembly 1.

In order to further ensure translational movement of the translation device 340 in the longitudinal direction of the phase shifter assembly 1, a constraint device 360 may be provided. The constraint device 360 is configured to allow the translation device 340 to move only in the longitudinal direction, while limiting movement of the translation device 340 in other directions. For example, the constraint device 360 may be in the form of a longitudinal rail, along which the translation device 340 slides. To be understood, those skilled in the art can anticipate that the constraint device 360 may be in any other suitable forms so far as the translation device 340 can be constrained as to perform translational movement in the longitudinal direction of the phase shifter assembly 1.

As a non-limiting example, in the embodiment as shown in the drawings, the constraint device 360 includes a guide element 361 that is fixed to the substrate 10. The connection rod 344 is coupled to the guide element 361 and can slide along and with respect to the guide element 361 in the longitudinal direction. Under the constraints of the guide element 361, the connection rod 344, the cross member 345 and the translation member 341 all perform translational movement in the longitudinal direction of the phase shifter assembly 1 without any movement in other directions.

In the embodiment shown in the drawings, four guide elements 361 are provided; however, those skilled in the art can appreciate that the number and position of the guide elements 361 are not limited to the forms as shown in the drawings but can be selected as actually required.

As can be seen from the above description, by means of the linkage mechanism 300, the first-stage phase shifter 100 and the second-stage phase shifter 200 in the phase shifter assembly 1 can be applied to the same PCB, i.e., the first-stage phase shifter 100 and the second-stage phase shifter 200 may be arranged on the same PCB. During operation of the phase shifter assembly 1, the first-stage phase shifter 100 and the second-stage phase shifter 200 may operate in association with each other by means of the linkage mechanism 300 through associated movement of the rotation device 310 and the translation device 340.

Figure 3:
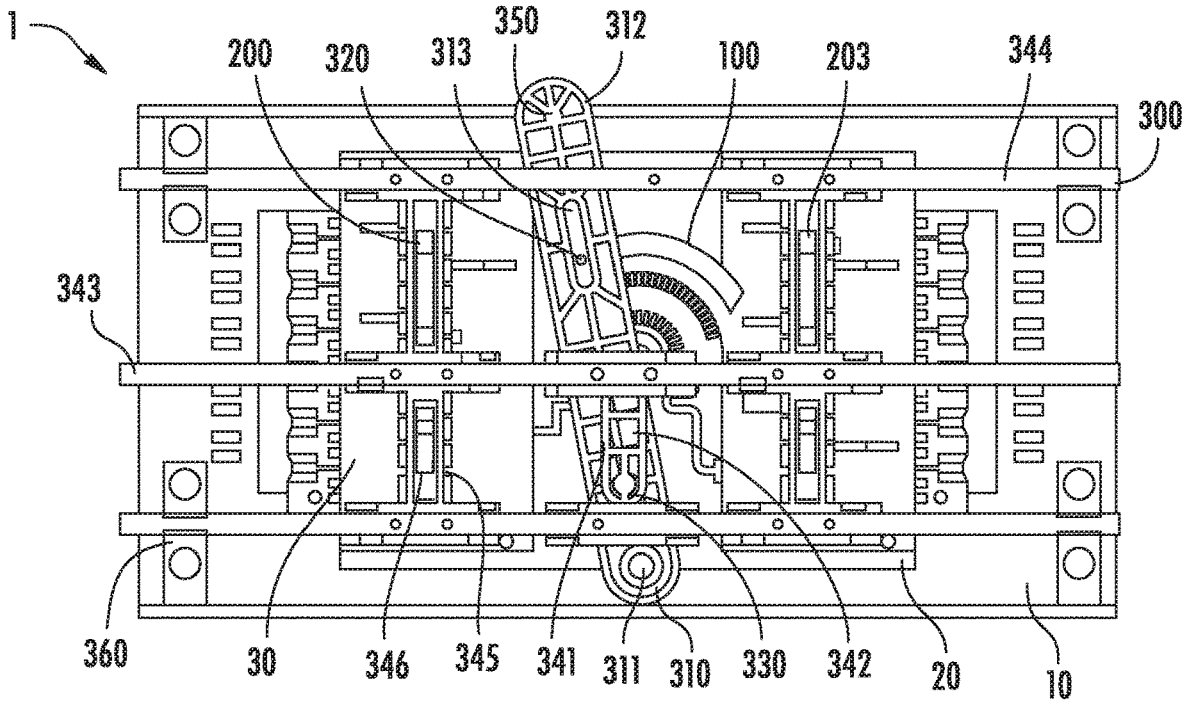
FIG. 3 is a top view of the phase shifter assembly of FIG. 1.
Figure 4:
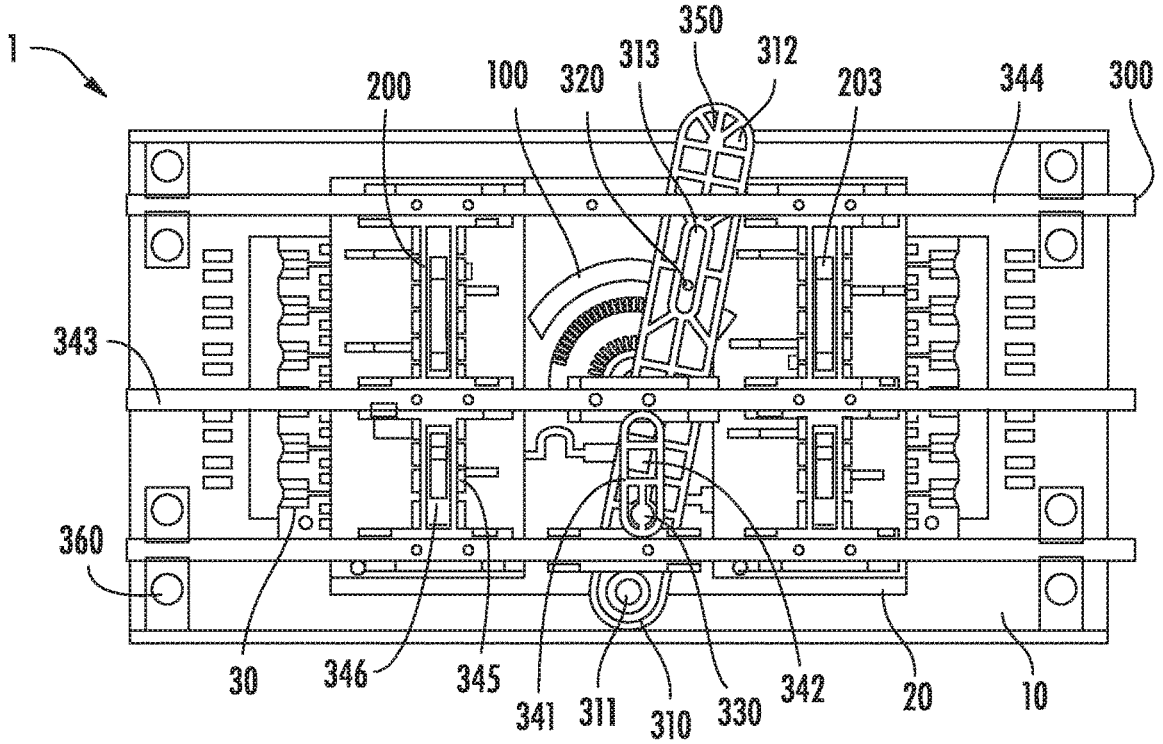
FIG. 4 is another top view of the phase shifter assembly of FIG. 1.

Specifically, as shown in FIGS. 3 and 4, the external drive source drives the third drive member 350, thereby causing the rotation member 312 to rotate about the rotation shaft 311. While the rotation member 312 is rotating about the rotation shaft 311, the first drive member 320 and the second drive member 330 are driven to rotate about the rotation shaft 311. Rotation of the first drive member 320 about the rotation shaft 311 drives the slider support 102 of the first-stage phase shifter 100 to rotate about the shaft 101, thereby generating a first-stage output signal that has a desired phase shift. Rotation of the second drive member 330 about the rotation shaft 311 drives the translation device 340 to perform translational movement in the longitudinal direction of the phase shifter assembly 1, thereby driving the slider supports 201 of the second-stage phase shifters 200 to move in the longitudinal direction, and this in turn generates second-stage output signals that have desired relative phase shifts.

Since the rotation device 310 and the translation device 340 move in association with each other and thus the first-stage phase shifter 100 and the second-stage phase shifter 200 operate in association with each other, the first-stage output signal generated by the first-stage phase shifter 100 and the second-stage output signal generated by the second-stage phase shifter 200 are associated with each other. The linkage mechanism 300 of the present disclosure may be configured to adjust the relationship between the first-stage output signal generated by the first-stage phase shifter 100 and the second-stage output signal generated by the second-stage phase shifter 200.

When location of the first drive member 320 with respect to the rotation shaft 311 changes, movement of the first drive member 320 changes accordingly. For example, in the case where the rotation member 312 performs the same movement, when the distance of the first drive member 320 from the rotation shaft 311 is relatively long, the distance the first drive member 320 moves is relatively long, whereas when the distance of the first drive member 320 from the rotation shaft 311 is relatively short, the distance the first drive member 320 moves is relatively short. When location of the second drive member 330 with respect to the rotation shaft 311 changes, movement of the second drive member 330 changes accordingly, and accordingly movement of the translation device 310 changes as well. For example, in the case where the rotation member 312 performs the same movement, when the distance of the second drive member 330 from the rotation shaft 311 is relatively long, the distance the second drive member 330 moves is relatively long, such that the translation device 310 moves a relatively long distance, whereas when the distance of the second drive member 330 from the rotation shaft 311 is relatively short, the distance the second drive member 330 moves is relatively short, such that the translation device 310 moves a relatively short distance. Therefore, when location of the first drive member 320 and/or the second drive member 330 with respect to the rotation shaft 311 changes, movement of the translation device 310 with respect to the first drive member 320 changes. In this case, the relationship between the first-stage output signal generated by the first-stage phase shifter 100 and the second-stage output signal generated by the second-stage phase shifter 200 may be adjusted by adjusting the location of the first drive member 320 and/or the second drive member 330 with respect to the rotation shaft 311.

The first drive member 320 may be operatively engaged to the rotation member 312 at different distances from the rotation shaft in order to change the proportional relationship between movement of the rotation member 312 and movement of the first drive member 320. Similarly, the second drive member 330 can be fixed to the rotation member 312 at different distances from the rotation shaft in order to change the proportional relationship between movement of the rotation member 312 and movement of the translation member 341. Therefore, by adjusting the locations of the first drive member 320 and/or the second drive member 330 on the rotation member 312, it is possible to change the proportional relationship between movement of the first drive member 320 and movement of the translation member 341, and further adjust the relationship between the first-stage output signal generated by the first-stage phase shifter 100 and the second-stage output signal generated by the second-stage phase shifter 200, that is, adjusting the output ratio between the first-stage phase shifter 100 and the second-stage phase shifter 200.

In an embodiment, location of the third drive member 350 with respect to the rotation shaft 311 is also adjustable so that, in the case of the same external drive source, the range of movement of the slider support 102 of the first-stage phase shifter 100 and the slider support 201 of the second-stage phase shifter 200 can be adjusted.

The foregoing is illustrative of the present disclosure and is not to be construed as limiting thereof. Although exemplary embodiments of this invention have been described, those skilled in the art should readily appreciate that many variations and modifications are possible in the exemplary embodiments without materially departing from the novel teachings and advantages of this invention. Accordingly, all such variations and modifications are intended to be included within the scope of this invention as defined in the claims. The invention is defined by the following claims, with equivalents of the claims to be included therein.

The invention claimed is:

1. A linkage mechanism for a phase shifter assembly, comprising:

a rotation device including:

a rotation shaft fixed to a secured substrate of the phase shifter assembly; and a rotation member pivotally coupled to the rotation shaft and configured to rotate about the rotation shaft in a plane substantially parallel to the substrate;

a first drive member that is operatively engaged to the rotation member such that rotation of the rotation member causes movement of the first drive member;

a second drive member disposed on and moving together with the rotation member; and a translation device including:

a translation member that is operatively engaged to the second drive member such that movement of the second drive member causes movement of the translation member, wherein the rotation device and the translation device are configured to move in association with each other during operation of the phase shifter assembly.

2. The linkage mechanism according to claim 1, wherein movement of the translation device with respect to the first drive member can be adjusted by adjusting a location of the first drive member and/or the second drive member with respect to the rotation shaft.

3. The linkage mechanism according to claim 1, wherein the rotation member is provided with a guide, along which the first drive member can move.

4. The linkage mechanism according to claim 1, wherein the translation member is provided with a guide, along which the second drive member can move.

5. The linkage mechanism according to claim 1, wherein the first drive member is configured to be operatively engaged to the rotation member at different positions along the rotation member so as to change the proportional relationship between movement of the rotation member and movement of the first drive member.

6. The linkage mechanism according to claim 1, wherein the second drive member is configured to be fixed to the rotation member at different positions along the rotation member so as to change the proportional relationship between movement of the rotation member and movement of the translation member.

7. The linkage mechanism according to claim 1, wherein the linkage mechanism is further provided with a third drive member disposed on the rotation member and coupled to an external drive source, wherein the third drive member is configured to drive the rotation member to rotate about the rotation shaft.

8. The linkage mechanism according to claim 1, wherein the translation device further includes a connection member, the translation member being fixed to the connection member.

9. A phase shifter assembly, comprising:

the linkage mechanism according to claim 1;

a first-stage phase shifter, the first drive member being coupled to the first-stage phase shifter; and a second-stage phase shifter, the translation member being coupled to the second-stage phase shifter.

10. The phase shifter assembly according to claim 9, wherein a portion of the first-stage phase shifter and a portion of the second-stage phase shifter are disposed on the same printed circuit board and operate in association with each other by means of the linkage mechanism.

11. The phase shifter assembly according to claim 9, wherein an output ratio between the first-stage phase shifter and the second-stage phase shifter can be adjusted by adjusting a location of the first drive member and/or a location of the second drive member with respect to the rotation shaft.

12. The phase shifter assembly according to claim 9, wherein the first-stage phase shifter is a rotary phase shifter and the second-stage phase shifter is a sliding phase shifter.

13. The phase shifter assembly according to claim 9, wherein the phase shifter assembly includes one first-stage phase shifter and a plurality of second-stage phase shifters.

14. The phase shifter assembly according to claim 9, wherein the phase shifter assembly includes one first-stage phase shifter and five second-stage phase shifters.

15. The phase shifter assembly according to claim 9, wherein the translation device further includes a connection member, the translation member being fixed to the connection member.

16. The phase shifter assembly according to claim 15, wherein the connection member includes connection rods arranged in parallel to each other and a cross member arranged substantially perpendicular to the connection rods and connecting the connection rods to each other.

17. The phase shifter assembly according to claim 16, wherein the phase shifter assembly further includes a fourth drive member fixed to the second-stage phase shifter, wherein the cross member is operatively coupled to the fourth drive member so that the translation member drives the second-stage phase shifter to operate via the connection member, the cross member and the fourth drive member.

18. The phase shifter assembly according to claim 17, wherein the cross member is provided with a guide, and the fourth drive member can move along the guide of the cross member.

19. A phase shifter assembly, comprising:

a printed circuit board;

a first electromechanical phase shifter that is partially implemented on the printed circuit board, the first electromechanical phase shifter including a first moveable member;

a second electromechanical phase shifter that is partially implemented on the printed circuit board, the second electromechanical phase shifter including a second moveable member; and a mechanical linkage mechanism that moves the second moveable member in response to movement of the first moveable member, wherein the first electromechanical phase shifter is a rotary phase shifter and the second electromechanical phase shifter is a linearly sliding phase shifter.

* * * * *